US008605405B2

(12) United States Patent
Giacobbe

(10) Patent No.: US 8,605,405 B2
(45) Date of Patent: Dec. 10, 2013

(54) METHOD AND CIRCUIT FOR INCREASING THE SPEED OF ELECTROMECHANICAL OUTPUT ON A PROTECTIVE RELAY

(75) Inventor: Mark C. Giacobbe, Coplay, PA (US)

(73) Assignee: ABB Technology AG, Zurich (CH)

( * ) Notice: Subject to any disclaimer, the term of this patent is extended or adjusted under 35 U.S.C. 154(b) by 65 days.

(21) Appl. No.: 13/300,706

(22) Filed: Nov. 21, 2011

(65) Prior Publication Data

US 2013/0128408 A1 May 23, 2013

(51) Int. Cl.
*H01H 47/32* (2006.01)

(52) U.S. Cl.
USPC ..... 361/154

(58) Field of Classification Search
USPC ..... 361/154
See application file for complete search history.

(56) References Cited

U.S. PATENT DOCUMENTS

| | | | | | |
|---|---|---|---|---|---|
| 3,514,672 | A | * | 5/1970 | Westbrook | 361/198 |
| 3,582,718 | A | * | 6/1971 | Spellman | 361/154 |
| 3,735,248 | A | * | 5/1973 | Reese | 324/522 |
| 4,207,852 | A | * | 6/1980 | Ohki et al. | 123/651 |
| 4,302,747 | A | * | 11/1981 | Belmuth | 180/287 |
| 4,318,154 | A | * | 3/1982 | DePuy | 361/155 |
| 4,994,727 | A | * | 2/1991 | Yang | 320/105 |
| 5,128,825 | A | * | 7/1992 | Hurley et al. | 361/154 |
| 5,410,187 | A | | 4/1995 | Meyer | |
| 5,483,131 | A | * | 1/1996 | Ito | 318/130 |
| 5,590,013 | A | | 12/1996 | Harasawa | |
| 5,633,779 | A | | 5/1997 | Knoble et al. | |
| 5,784,244 | A | | 7/1998 | Moran et al. | |
| 6,023,110 | A | | 2/2000 | Henrion et al. | |
| 6,407,893 | B1 | * | 6/2002 | Neiger et al. | 361/42 |
| 7,248,453 | B2 | * | 7/2007 | Ahrendt | 361/154 |

FOREIGN PATENT DOCUMENTS

| | | | |
|---|---|---|---|
| EP | 0535844 | A1 | 4/1993 |
| JP | 58193442 | U | 12/1983 |
| JP | 60049607 | U | 4/1985 |
| JP | 61088419 | A | 5/1986 |
| JP | 61104517 | A | 5/1986 |

OTHER PUBLICATIONS

PCT Search Report & Written Opinion in PCT/US12/063483 dated Feb. 8, 2013.

* cited by examiner

*Primary Examiner* — Roanld W Leja
(74) *Attorney, Agent, or Firm* — Manelli Selter PLLC; Edward J. Stemberger

(57) ABSTRACT

A method of increasing speed of an electro-mechanical relay provides an electro-mechanical relay having a coil and at least one contact. A first resistor and a second resistor are each in series with the coil, with the second resistor being in parallel with a first switch. A voltage is provided to the first switch, with the first switch being ON, thereby shorting out the second resistor and providing a first current through the first resistor and to the coil, to move the contact to a closed position. After a certain amount of time, the first switch is turned OFF so that a second current is provided through the first and second resistors and to the coil, maintaining the contact in the closed position.

14 Claims, 2 Drawing Sheets

METHOD AND CIRCUIT FOR INCREASING THE SPEED OF ELECTROMECHANICAL OUTPUT ON A PROTECTIVE RELAY

FIELD

The invention relates to binary outputs on protective relays for the protection of electrical equipment in a power distribution system and, more particularly, a method and circuit for increasing the speed of electro-mechanical relays of a protective relay.

BACKGROUND

In automated power transmission and distribution, a basic function of a protection relay is to protect electrical equipment by tripping a circuit breaker and interrupting a power line in case of over current or earth fault situations. Outputs on a protective relay are normally electro-mechanical relays. When current is applied to the coil of the relay, a magnetic force is developed. This magnetic force is determined by the amps multiplied by the turns of the coil. The more turns or more current (or both) that are applied to the coil, the larger the magnetic force. This magnetic force then pulls a lever, which is inside of the relay, to the coil. The lever, in turn, moves output contacts of the relay to either open, close (or both open and close), depending on the construction of the relay. When the contacts close on electromechanical relays, they bounce due to the force of the contacts closing. The faster the contacts close, the more force there is, and the more the contacts bounce.

These electro-mechanical relays have a turn-on time anywhere from 2 to 10 mS from the application of voltage to the respective coil. Contact bounce is typically 2 mS. In most applications of protective relays, this delayed turn-on time is tolerated. There are certain applications where a faster response from the output is needed, such as for arc flash protection.

Thus, there is a need to provide a method circuit structure to increase the closing time of electromechanical relays without increasing the amount of bouncing when the contacts close.

SUMMARY

An object of the invention is to fulfill the need referred to above. In accordance with the principles of the present invention, this objective is achieved by a method of increasing speed of an electro-mechanical relay. The method provides an electro-mechanical relay having a coil and at least one contact. A first resistor and a second resistor are each in series with the coil, with the second resistor being in parallel with a first switch. A voltage is provided to the first switch, with the first switch being ON, thereby shorting out the second resistor and providing a first current through the first resistor and to the coil, to move the contact to a closed position. After a certain amount of time, the first switch is turned OFF so that a second current is provided through the first and second resistors and to the coil, maintaining the contact in the closed position.

In accordance with another aspect of an embodiment, circuit structure for increasing speed of an electro-mechanical relay includes an electro-mechanical relay having a coil and at least one contact. A first resistor and a second resistor are each provided in series with the coil, with the second resistor being in parallel with a first switch. A voltage source is constructed and arranged to provide a voltage to the first switch when the first switch is ON to short-out the second resistor and provide a first current through the first resistor and to the coil, to move the contact to a closed position. A second switch is constructed and arranged to turn the first switch OFF, so that a second current is provided through the first and second resistors and to the coil, maintaining the contact in the closed position.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawing wherein like numbers indicate like parts, in which.

DETAILED DESCRIPTION OF THE EXEMPLARY EMBODIMENTS

Figure 1:
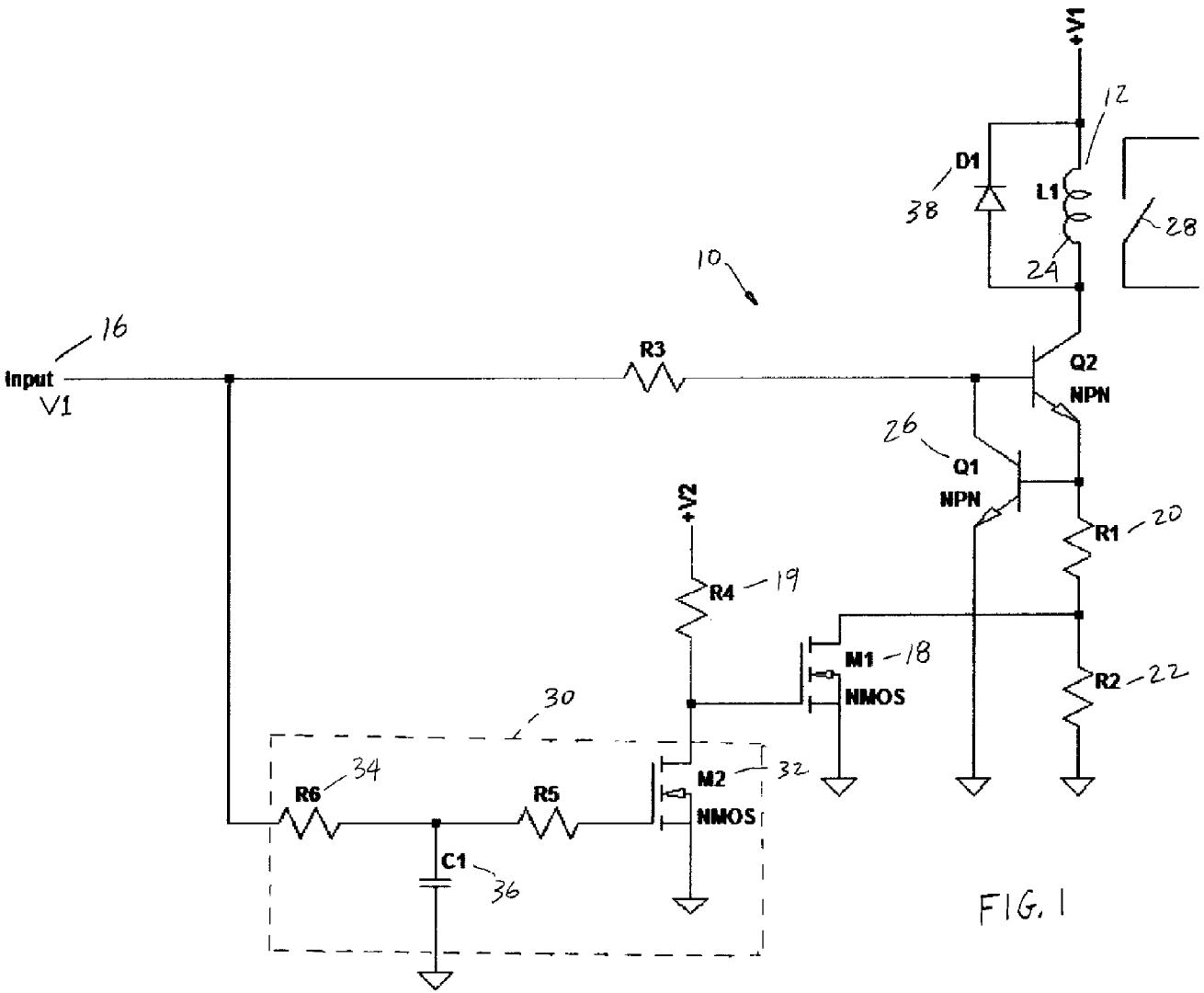
FIG. 1 is a schematic view of circuit structure for increasing closing time of an electro-mechanical relay in accordance with the present invention.
Figure 2:
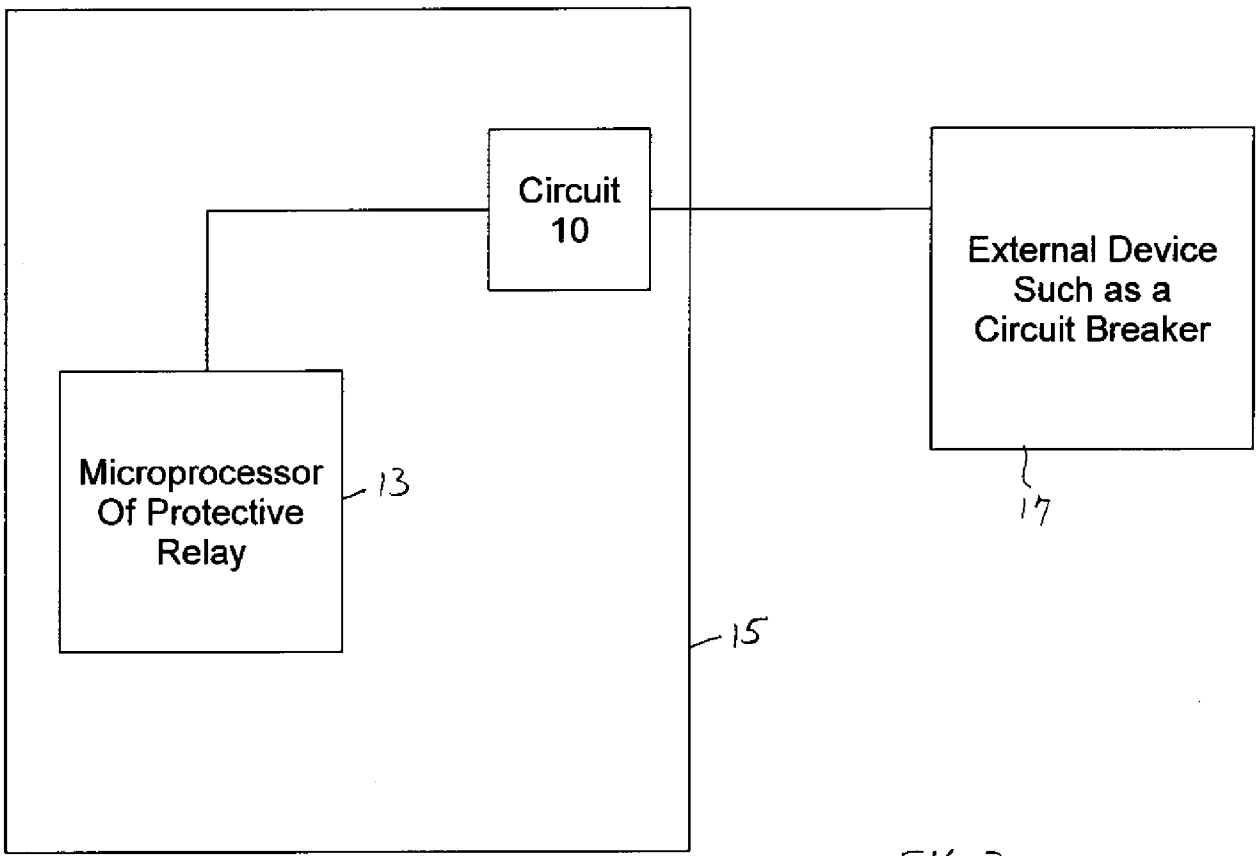
FIG. 2 is a block diagram showing the circuit structure of FIG. 1 employed as an output relay of a protective relay.

With reference to FIG. 1, circuit structure for increasing closing time of an electro-mechanical relay is shown, generally indicated at 10, in accordance with an embodiment. The circuit structure 10 includes output relay 12 (L1), preferably connected to a microprocessor 13 of a protective relay 14 for protecting an external device such as a circuit breaker 17, as shown in FIG. 2.

When the voltage source or input 16 to the circuit structure 10 is low, the relay 12 is de-asserted. When the input 16 is high (asserted) via a voltage pulse V1, a first switch or metal-oxide-semiconductor field-effect transistor (MOSFET) 18 (M1) is ON by default due to the presence of resistor 19 (R4). A first resistor 20 (R1) and a second resistor 22 (R2) are each in series with the coil 24 of the relay 12, with the second resistor 22 being in parallel with the first switch 18. With MOSFET or first switch 18 being ON, resistor 22 (R2) is shorted-out or bypassed and a first current is provided through the output relay 12 that is determined by the Vbe (voltage from the base to the emitter) of transistor 26 (Q1) divided by the value of resistor 20 (R1). Resistor 20 is set for a current of large magnitude. Thus, the first current is a large current and is applied to the coil 24 of the relay 12, creating a large magnetic force. This increase of magnetic force makes the contact(s) 28 of the relay 12 start to close faster, absent shorting-out the second resistor 22.

Once the contact(s) 28 of the relay 12 start to move, the current to the coil 24 of the relay 12 is reduced, thus reducing the magnetic force, slowing down the contact(s). Thus, after a predetermined time, set by a timing circuit 30, MOSFET 18 is turned-off by a second switch or MOSFET 32 (M2). This provides a second current through the relay 12 equal to Vbe of the transistor 26 divided by resistance of resistor 20 (R1) plus the resistance of resistor 22 (R2). Thus, the second current is less than the first current that flows through relay 12. The timing of the circuit 30 is determined by resistor 34 (R6) and capacitor 36 (C1).

Diode 38 (D1) is provided to eliminate back EMF of relay 12 when the relay 12 is turned off.

Thus, the circuit structure 10 increases the closing time of the electro-mechanical relay 12 to approximately 1 mS with the bouncing time of the contacts still about 2 mS.

There are other ways of achieving the same operation of circuit structure 10. For example, a solid state relay can be used, but components for solid state relays are hard to find to cover the requirements for Protective Relay output relays (high voltage and high current). Furthermore, solid-state devices require additional circuitry since they need to be isolated from the protective relay. The circuit structure 10 overcomes the output solid state issues by not using them, since only the electro-mechanical relay 12 is used. All the parts of the circuit structure 10 are on the non-isolated, low voltage/current side of the relay 12.

It is contemplated that instead of using discrete components for the timing circuits, a timing Integrated Circuit (IC) can be used. Furthermore, instead of using the constant current source, a PWM signal can be used.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A method of increasing speed of an electro-mechanical relay, the method comprising the steps of:

providing an electro-mechanical relay having a coil and at least one contact, providing a first resistor and a second resistor, each in series with the coil, with the second resistor being in parallel with a first switch, providing a voltage to the first switch, with the first switch being ON, thereby shorting out the second resistor and providing a first, constant current through the first resistor and to the coil, to move the contact to a closed position, thereby establishing a closing time of the contact to be about 1 mS, and after a certain amount of time, turning the first switch OFF, so that a second constant current is provided through the first and second resistors and to the coil, maintaining the contact in the closed position, thereby minimizing bouncing of the contact, wherein the electro-mechanical relay is provided as an output relay of a protective relay.

2. The method of claim 1, wherein the first switch is a metal-oxide-semiconductor field-effect transistor (MOSFET).

3. The method of claim 1, wherein the step of turning off the first switch includes using a second switch.

4. The method of claim 3, wherein the second switch is a MOSFET.

5. The method of claim 1, further providing a transistor such that the first current is Vbe of the transistor, divided by a value of the first resistor.

6. The method of claim 5, wherein the second current is Vbe of the transistor divided by the value of the second resistor plus a value of the first resistor.

7. A circuit structure for increasing speed of an electro-mechanical relay, the circuit comprising:

an electro-mechanical relay having a coil and at least one contact, a first resistor and a second resistor, each in series with the coil, with the second resistor being in parallel with a first switch, a voltage source constructed and arranged to provide a voltage to the first switch when the first switch is ON to short-out the second resistor and provide a first constant current through the first resistor and to the coil, to move the contact to a closed position, thereby establishing a closing time of the contact to be about 1 mS, and a second switch constructed and arranged to turn the first switch OFF, so that a second constant current is provided through the first and second resistors and to the coil, maintaining the contact in the closed position, thereby minimizing bouncing of the contact, wherein the electro-mechanical relay is an output relay of a protective relay.

8. The circuit structure of claim 7, wherein the first switch is a metal-oxide-semiconductor field-effect transistor (MOSFET).

9. The circuit structure of claim 7, wherein the second switch is a MOSFET.

10. The circuit structure of claim 7, further comprising a transistor, and wherein the first current is Vbe of the transistor divided by a value of the first resistor.

11. The circuit structure of claim 10, wherein the second current is Vbe of the transistor divided by the value of the second resistor plus a value of the first resistor.

12. The circuit structure of claim 7, in combination with the circuit breaker.

13. The circuit structure of claim 7, wherein the second switch is part of a timing circuit and is constructed and arranged to turn OFF the first switch at certain time after the first switch has been ON to short-out the second resistor.

14. The circuit structure of claim 13, wherein the timing circuit includes a resistor and capacitor that is constructed and arranged to determine the certain time.

* * * * *